US011959720B2

(12) United States Patent
Halbeisen

(10) Patent No.: US 11,959,720 B2
(45) Date of Patent: Apr. 16, 2024

(54) MAGAZINE LOADING AID

(71) Applicant: nine reloaded GmbH, Nenzing (AT)

(72) Inventor: Jürgen Halbeisen, Nenzing (AT)

(73) Assignee: nine reloaded GmbH, Nenzing (AT)

( * ) Notice: Subject to any disclaimer, the term of this patent is extended or adjusted under 35 U.S.C. 154(b) by 0 days.

(21) Appl. No.: 18/163,413

(22) Filed: Feb. 2, 2023

(65) Prior Publication Data

US 2023/0175798 A1 Jun. 8, 2023

Related U.S. Application Data

(63) Continuation-in-part of application No. PCT/EP2021/066908, filed on Jun. 22, 2021.

(30) Foreign Application Priority Data

Aug. 4, 2020 (AT) ..... A 174/2020

(51) Int. Cl.
*F41A 9/83* (2006.01)

(52) U.S. Cl.
CPC ..... *F41A 9/83* (2013.01)

(58) Field of Classification Search
CPC ..... F41A 9/83
See application file for complete search history.

(56) References Cited

U.S. PATENT DOCUMENTS 5,249,386 A 10/1993 Switzer
7,503,138 B2 3/2009 Tal et al.
7,637,048 B2 12/2009 Tal et al.
9,909,827 B1 3/2018 Higby
11,029,108 B1 6/2021 Tal et al.
11,041,684 B1 6/2021 Higby
11,204,213 B1 * 12/2021 Chen ..... F41A 9/83
11,313,634 B1 * 4/2022 Newby ..... F41A 9/83
(Continued)

FOREIGN PATENT DOCUMENTS

AT 9463 U1 10/2007
CA 2604965 A1 10/2006
(Continued)

OTHER PUBLICATIONS

Austrian Search Report dated Nov. 18, 2020 for Austrian Patent Application No. A 174/2020.
(Continued)

*Primary Examiner* — J. Woodrow Eldred
(74) *Attorney, Agent, or Firm* — Volpe Koenig

(57) ABSTRACT

A loading aid device for a stick magazine (2) includes a holder part (1) for inserting the stick magazine, a feed part (13) held on the holder part for displaceable guidance of cartridge(s) (8) to be loaded, a thrust piece (14) which is adjustable between passive and active positions in order to push down the magazine feed (11) together with cartridges possibly already located in the receiving space (9) of the stick magazine and to free up a front free space in a front region of the receiving space, and a pusher (16) which is adjustable between a feed position and a push-in position for pushing one of the cartridges to be loaded into a rear free space which can be freed up during pulling back of the thrust piece from the active position in the direction of the passive position in a rear region of the receiving space.

17 Claims, 10 Drawing Sheets

(56) References Cited

U.S. PATENT DOCUMENTS

| | | | | |
|---|---|---|---|---|
| 2007/0107291 | A1 | 5/2007 | Tal et al. | |
| 2008/0184608 | A1* | 8/2008 | Tal | F41A 9/83 42/87 |
| 2016/0202007 | A1 | 7/2016 | Hatch | |
| 2018/0058785 | A1* | 3/2018 | Hefer | F41A 9/83 |
| 2019/0226781 | A1 | 7/2019 | Derus et al. | |
| 2020/0158454 | A1 | 5/2020 | Oross | |

FOREIGN PATENT DOCUMENTS

| | | | |
|---|---|---|---|
| DE | 202007000335 | | 4/2007 |
| DE | 102015006801 | B3 | 11/2016 |
| IL | 186088 | A | 3/2011 |

OTHER PUBLICATIONS

Elite Tactical Systems Group, LLC, ETS Speedloaders, https://www.etsgroup.us/articles.asp?id=257 (2020).

Elite Tactical Systems Group, LLC, Rifle and Pistol Speedloaders, https://www.etsgroup.us/Rifle-and-Pistol- Speedloaders-a/261.htm Available at: http://web.archive.org/web/20210116072540/https://www.etsgroup.us/Rifle-and-Pistol-Speedloaders-a/261.htm (Jan. 16, 2021).

Magpump, 9MM Luger Magazine Loader, https://magpump.com/products/handgun-magazine-loaders/9mm-luger- magazine-loader, Available at: http://web.archive.org/web/20201111165848/https://magpump.com/products/handgun-magazine-loaders/9mm-luger-magazine-loader (Nov. 11, 2020).

Caldwell, Mag Charger Universal Pistol Loader, https://www.caldwellshooting.com/range-gear/pistol-accessories/mag-charger-universal-pistol-loader/110002.html , Available at: http://web.archive.org/web/20201030194842/https://www.caldwellshooting.com/range-gear/pistol-accessories/mag-charger-universal-pistol-loader/110002.html (Oct. 30, 2020).

* cited by examiner

MAGAZINE LOADING AID

CROSS-REFERENCE TO RELATED APPLICATIONS

This application is a continuation-in-part of International Patent Application No. PCT/EP2021/066908, filed Jun. 22, 2021, which claims priority to Austrian Patent Application No. A 174/2020, filed Aug. 4, 2020, both of which are incorporated herein by reference as if fully set forth.

TECHNICAL FIELD

The invention relates to a loading aid device for a stick magazine which has a receiving space for cartridges and a magazine feeder which is acted upon by a magazine spring for pushing the uppermost of the cartridges located in the stick magazine against magazine lips of the stick magazine, comprising a holder part for inserting and fastening the stick magazine and a feed part held on the holder part for displaceable guidance of at least one cartridge to be loaded. The invention furthermore relates to a method for loading a stick magazine which has a receiving space for cartridges and a magazine feeder which is acted upon by a magazine spring for pushing the uppermost of the cartridges located in the receiving space against magazine lips of the stick magazine, by means of a loading aid device which has a holder part for inserting and fastening the stick magazine and a feed part held on the holder part for displaceable guidance of at least one cartridge to be loaded.

BACKGROUND

Stick magazines for receiving cartridges of firearms have a receiving space for the cartridges in which they are arranged in a stacked manner in one or two rows (the two rows offset in terms of height). The receiving space is delimited at the upper output end by magazine lips which taper the width of the receiving space and against which the uppermost of the cartridges located in the magazine bears, wherein a magazine feeder acted upon by a magazine spring acts on the lowermost of the cartridges located in the magazine or in the case of a two-row magazine on the lowermost cartridges of the two rows in order to push the uppermost cartridge located in the magazine against the magazine lips.

In order to load a stick magazine, the cartridges are normally introduced individually by hand into the stick magazine in that they, in a front region of the magazine before which the magazine lips end, are pushed in against the magazine feeder or the cartridges already located in the magazine and as a result are introduced into a front region of the receiving space of the magazine and are furthermore pushed into the rear region of the receiving space and below the magazine lips. This process requires a relatively large amount of force and is laborious.

Loading aid devices for stick magazines which have a holder part which can be placed onto an upper portion of the stick magazine and in which the stick magazine is held in a similar manner to the firearm have already become known. A feed part in the form of a rail with an undercut groove is fitted on the holder part, in which undercut groove the cartridges to be loaded have been threaded prior to placing onto the magazine. The cartridges arranged in a row in the feed part and lying on the upper side of the magazine are consequently pushed manually into the receiving space of the magazine with a handpiece which is displaceable along the rail-like receiving part and lies on the uppermost of the cartridges. The loading of the magazine can indeed be accelerated as a result of this, but the amount of force which has to be exerted to push the cartridges with the handpiece into the receiving space of the magazine is significant.

A loading aid device with a holder part which can be placed onto an upper portion of the stick magazine and on which an actuating part formed as a lever is pivotably mounted is furthermore known by prior use. By actuating the actuating part, an individual cartridge inserted into the loading aid device is pushed by a thrust piece past the magazine lips into a front region of the receiving space of the stick magazine and then pushed by a pusher into the rear region of the receiving space under the magazine lips. In the case of this loading aid device, the cartridges to be loaded must be inserted in each case individually into the loading aid device.

SUMMARY

The object of the invention is to provide an advantageous loading aid device of the above-mentioned type which enables easy, quick and low-force loading of the stick magazine. This is achieved by a loading aid device with one or more of the features disclosed herein as well as by a method with one or more of the features disclosed herein.

The loading aid device according to the invention has a thrust piece which is adjustable between a passive position, in which it is located entirely outside the receiving space (9) of the stick magazine (2), and an active position, in which a tappet portion (14*c*) of the thrust piece (14) protrudes between the magazine lips (10) into the receiving space (9) of the stick magazine (2), wherein this adjustment of the thrust piece between the passive position and the active position of the thrust piece serves to push down the magazine feeder together with cartridges possibly already located in the receiving space of the stick magazine. As a result of this, a front free space is freed up in a front region of the receiving space of the stick magazine. The loading aid device according to the invention furthermore has a pusher which is adjustable between a feed position and a push-in position. The adjustment of the pusher from the feed position to the push-in position serves to push in one of the cartridges to be loaded which has been fed in the active position of the thrust piece and feed position of the pusher from the feed part into the front free space of the receiving space of the stick magazine, into a rear free space located in a rear region of the receiving space, which rear free space has been freed up by the thrust piece during pulling back of the thrust piece from the active position in the direction of the passive position. The cartridge is thus fully received in the receiving space of the stick magazine. The cartridge is thus located in a loading position.

The loading process is advantageously performed by the interaction of the movement of the thrust piece from the passive position into the active position and back into the passive position as well as the movement coupled thereto of the pusher from the push-in position into the feed position and back into the push-in position.

Several cartridges to be loaded can advantageously be received by the loading aid device according to the invention, wherein several cartridges to be loaded can be inserted into the feed part and are guided displaceably by it.

The adjustment of the pusher from the feed position into the push-in position is preferably performed by a tension spring which acts upon the pusher in the direction of the push-in position. A cartridge to be loaded can thus be pushed by the pusher through the action of the tension spring into the rear region of the receiving space and thus into its loading position.

For the purpose of adjustment of the thrust piece from the passive position into the active position and to adjust the pusher from the push-in position into the feed position, an actuating part is advantageously present which is mechanically coupled both to the thrust piece and to the pusher and which is adjustable from a starting position into an actuating position. The adjustment of the pusher from the push-in position into the feed position and the adjustment of the thrust piece from the passive position into the active position are thus brought about during the adjustment of the actuating part from the starting position into the actuating position.

The feed of the cartridge to be loaded into the front free space of the receiving space in the active position of the thrust piece and in the feed position of the pusher is advantageously performed by the action of gravitational force as soon as, in a front region of the receiving space which lies next to the tappet portion, the front free space with a sufficient size is freed up and the pusher has moved sufficiently far in the direction of the feed position. The front free space extends to below a front portion of the magazine lips below which the cartridge comes to lie in the region of its rear end.

The thrust piece is advantageously mounted in a linearly displaceable manner on the holder part, wherein it is preferably acted upon by a return spring into the passive position.

In one advantageous embodiment of the invention, the actuating part, which, for actuation, preferably has a grip portion, about which an actuating part pivot axis is mounted pivotably on the holder part. The actuating part is advantageously acted upon by spring force into the starting position, in particular by the return spring acting on the thrust piece and the coupling of the actuating part to the thrust piece.

The adjustment of the thrust piece is expediently performed in both directions in a forcibly coupled manner by the actuating part, i.e. in the case of a continuous adjustment of the actuating part from the starting position into the actuating position a continuous adjustment of the thrust piece from the passive position into the active position is performed and in the case of a continuous adjustment of the actuating part from the actuating position into the starting position a continuous resetting of the thrust piece from the active position into the passive position is performed.

The coupling between the actuating part and the pusher is expediently forcibly coupled only in one direction, i.e. a continuous adjustment of the pusher from the push-in position into the feed position is performed in the case of a continuous adjustment of the actuating part from the starting position into the actuating position, while the pusher can remain in the same position in the case of a continuous adjustment of the actuating part from the actuating position into the starting position at least over a portion of this adjustment of the actuating part. This is enabled in one advantageous embodiment of the invention in that the pusher has at least one guide pin and the actuating part has at least one guide surface, wherein the at least one guide pin of the pusher bears against the assigned guide surface of the actuating part only on one side. Instead, the actuating part could also have at least one guide pin which bears against the guide surface of the pusher only on one side. Other formations of such an at least partial release of the movement between the actuating part and the pusher are conceivable and possible, for example, by a guide pin which is arranged on one of the two parts and projects into a window recess on the other of these two parts, wherein the window recess has a larger clearance than the guide pin.

In one advantageous embodiment of the invention, the feed part has a rail with an undercut groove. Several cartridges to be loaded can be threaded into this undercut groove and be guided displaceably therein, wherein their feed to the front region of the receiving space in the active position of the thrust piece and push-in position of the pusher is performed by gravitational force.

If the terms "top" and "bottom" are used in the context of this document with reference to a stick magazine, this relates to an alignment in which the magazine lips of the stick magazine inserted into the loading aid device are located at the top.

If the terms "front" and "rear" are used in this publication, this relates to the firing direction of the cartridges.

BRIEF DESCRIPTION OF THE DRAWINGS

Further advantages of the invention will be explained below on the basis of the enclosed drawing. In this drawing.

DETAILED DESCRIPTION

Figure 1:
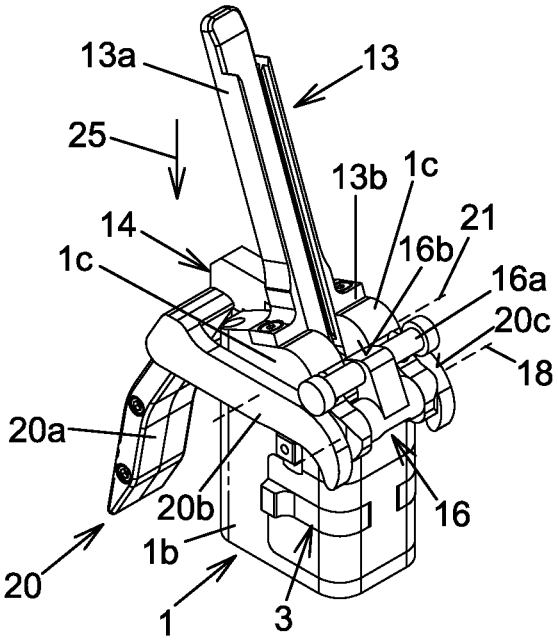
FIG. 1 shows an oblique view of an exemplary embodiment of a loading aid device according to the invention in the starting position of the actuating part (and thus passive position of the thrust piece and push-in position of the pusher)
Figure 2:
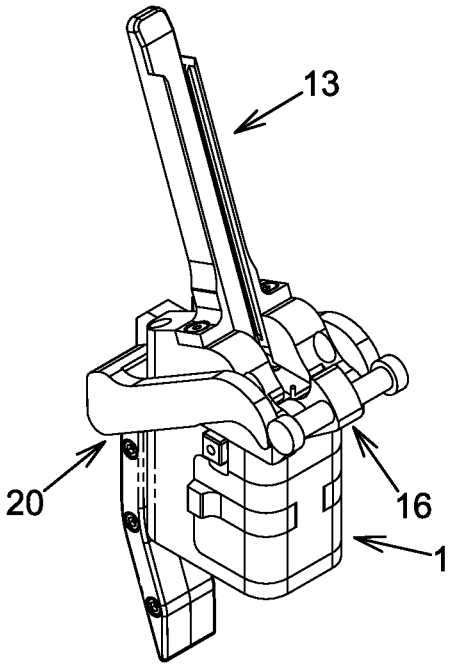
FIG. 2 shows an oblique view corresponding to FIG. 1 in the actuating position of the actuating part (and thus active position of the thrust piece and feed position of the pusher)
Figure 3:
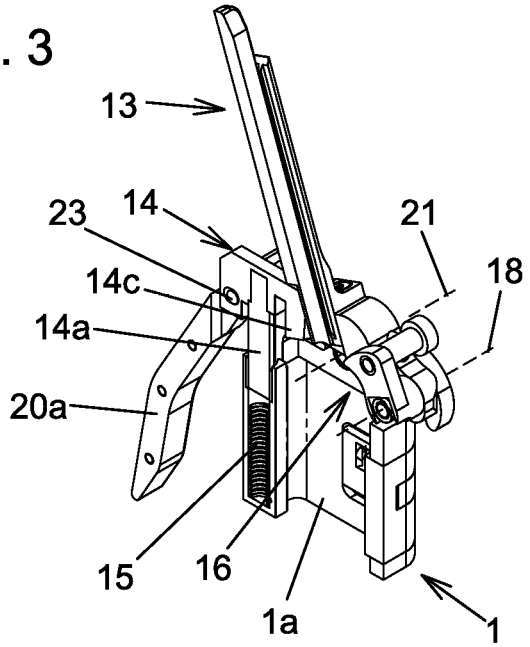
FIGS. 3 and 4 show the loading aid device cut open in the longitudinal center in the positions according to FIGS. 1 and 2.
Figure 4:
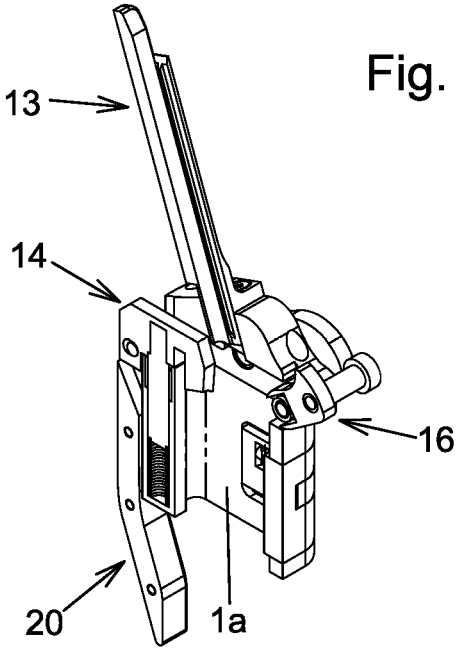

An exemplary embodiment of the invention is explained below on the basis of FIGS. 1 to 23.

The loading aid device has a holder part 1 which possesses a receiving opening 1*a* into which a stick magazine 2 with an upper portion can be pushed. The stick magazine 2 is fixed on the loading aid device after pushing into the receiving opening 1*a* of the holder part 1. The holding of the stick magazine 2 on the holder part 1 can be performed in an analogous manner to the conventional holding of the stick magazine 2 on a firearm. In particular, the holder part 1 can have for this purpose spring-actuated latching lugs 3*a* which engage in latching recesses 2*a* of the stick magazine 2. The latching lugs 3*a* can be arranged on preferably pivotably mounted latching elements 3. In order to open the holder and remove the stick magazine from the receiving opening of the holder part 1, the latching elements 3 can be pivoted counter to the force of the springs 4 which act upon the latching elements 3.

The latching elements 3 with the latching lugs 3*a* are, in the exemplary embodiment, arranged on an adapter element 5 which is held on a base part 1*b* of the holder part 1. By exchanging the adapter element 5, the holder part 1 can be adapted to different types of stick magazines, as various manufacturers use them. In order to exchange the adapter element, in the exemplary embodiment, a closure element 6 mounted displaceably on the base part of the holder part counter to the force of a spring 7 is displaced, whereupon the adapter element 5 can be removed from the base part of the holder part 1.

The base part 1*b* and the adapter part 5 jointly form a sleeve which has the receiving opening 1*a*.

The stick magazine 2 serves to receive cartridges 8, for example, 9 mm cartridges (=9×19 mm). The stick magazine 2 can be formed in a conventional manner in this case. It has a receiving space 9 for receiving the cartridges 8. The receiving space 9 is delimited at the top by magazine lips 10. These extend only over a rear part of the magazine, while there is a larger opening of the receiving space 9 at the top toward the outside in a front part of the magazine, which serves to load the magazine.

A magazine feeder 11 acted upon by a magazine spring 12 is arranged in the magazine, which magazine feeder 11 pushes the cartridges 8 arranged in the receiving space 9 upward, wherein the uppermost of these cartridges 8 bears against the magazine lips 10.

A feed part 13 is fixed on the holder part 1 of the loading aid device. This has a rail 13*a* with an undercut groove into which cartridges to be loaded are threaded. The cartridges 8 are thus guided displaceably from the feed part at a right angle to their longitudinal direction. The rail 13*a* is screwed on the holder part 1 in the execution part by means of flanges 13*b*.

The cartridges threaded into the undercut groove of the rail 13*a* are displaceable along the rail 13*a*.

A thrust piece 14 is mounted linearly displaceably on the holder part 1 parallel to a displacement direction 25 between a passive position (cf. FIGS. 1, 3, 5, 8, 9, 12, 16 and 19) and an active position (cf. FIGS. 2, 4, 6, 10 and 17). In the exemplary embodiment, a bearing pin 14*a* of the thrust piece 14 serves this purpose, which bearing pin 14*a* engages into a bearing recess of the holder part 1. A return spring 15 is arranged between the base of this bearing recess and the bearing pin 14*a*. In the unactuated state of the loading aid device, the return force 15 acts upon the thrust piece 14 into the passive position.

A pusher 16 is furthermore mounted pivotably on the holder part 1 between a push-in position (cf. FIGS. 1, 3, 5, 8, 9, 12, 16 and 19) and a feed position (cf. FIGS. 2, 4, 6, 10 and 17). The pivotable mounting of the pusher 16 is performed by means of a bearing pin 17 about a pusher pivot axis 18. This is at a right angle to the displacement direction 25. The pusher 16 is acted upon by a tension spring 19. In the unactuated state of the loading aid device, the tension spring 19 acts upon the pusher in a push-in position of the pusher 16.

An actuating part 20 formed as a lever is mounted pivotably on the holder part 1 about an actuating part pivot axis 21 between a starting position (cf. FIGS. 1, 3, 5, 8, 9, 12, 16 and 19) and an actuating position (cf. FIGS. 2, 4, 6, 10 and 17). The actuating part pivot axis 21 lies parallel to the pusher pivot axis 18. The actuating part 20 has a grip portion 20*a* which serves to actuate the loading aid device 1 by the user in order to load cartridges 8 into the stick magazine 2.

In the exemplary embodiment, the actuating part 20 is formed in two parts. The grip portion 20*a* is divided along its longitudinal center by the two parts screwed to one another. The two parts have in each case a guide extension 20*b* which possesses a guide surface 20*c*.

For pivotable mounting of the actuating part 20 on the holder part 1, the two parts of the actuating part 20 have, in the exemplary embodiment, in each case an axle journal 20*d* which engages in a bearing bush 22 arranged in the holder part 1. The bearing bushes 22 can also be dispensed with.

In each case a side plate 1*c* is fastened to the upper sides of the opposing wide-side walls of the base part 1*b* of the holder part 1. The pivotable mounting of the pusher 16 and of the actuating part 20 is performed on the side plates 1*c*. An intermediate space for the supply of cartridges 8 to the upper side of the stick magazine 2 is located between the side plates 1*c*.

By actuating the grip portion 20*a* of the actuating part 20, this can be pivoted between a starting position and an actuating position. The thrust piece 14 is in this case forcibly coupled to the actuating part 20 in both adjustment directions of the actuating part 20. In the exemplary embodiment, a coupling pin 23 which is attached to the actuating part and penetrates through a recess 14*b* in the thrust piece 14 serves this purpose. Since the actuating part 20 is pivotably mounted and the thrust piece 14 is mounted in a linearly displaceable manner, the recess 14*b* is formed as an elongate hole recess.

If the actuating part 20 is pivoted from the starting position into the actuating position, the thrust piece 14 is adjusted from the passive position into an active position by the forcible coupling to the actuating part 20. If the grip portion 20*a* is released by the user, the return spring 15 displaces the thrust piece 14 back into the passive position and in this case the actuating part 20 is pivoted back into the starting position as a result of the coupling to the actuating part 20.

The pusher 16 has guide pins 16*a* which protrude on opposing sides, are oriented parallel to the pusher pivot axis 18 and interact with the guide surfaces 20*c* of the actuating part 20. If the actuating part 20 is pivoted from the starting position into the actuating position, a pivoting of the pusher 16 from the push-in position into the feed position of the pusher 16 is thus performed through the interaction of the guide pins 16*a* with the guide surfaces 20*c*.

If the actuating part 20 is released by the user and pivoted back into the starting position through the action of the return spring 15, the guide pins 16*a* are held by the action of the tension spring 19 to bear against the guide surfaces 20*c* and the pusher 16 is adjusted back into the push-in position. This is, however, not essential. If the pusher 16 is fixed in the feed position, the actuating part 20 can nevertheless pivot back into the starting position with the lifting up of the guide pins 16*a* from the guide surfaces 20*c*. Such a lifting up of the guide pins 16*a* from the guide surfaces 20*c* over a portion of the resetting of the actuating part 20 from the actuating position into the starting position is performed during the loading process, as well be explained in greater detail below.

Figure 5:
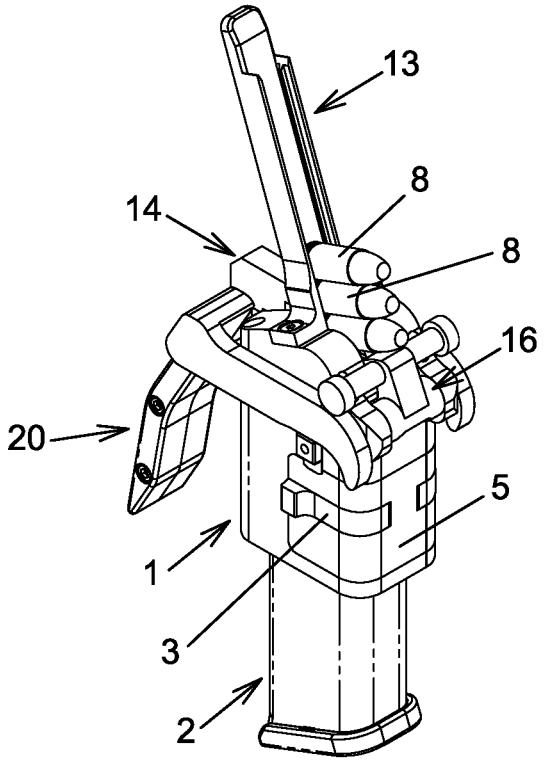
FIG. 5 shows the loading aid device placed onto a stick magazine, wherein the stick magazine is held on the loading aid device, with cartridges inserted into the feed part, in the position of the loading aid device corresponding to FIG. 1.
Figure 7:
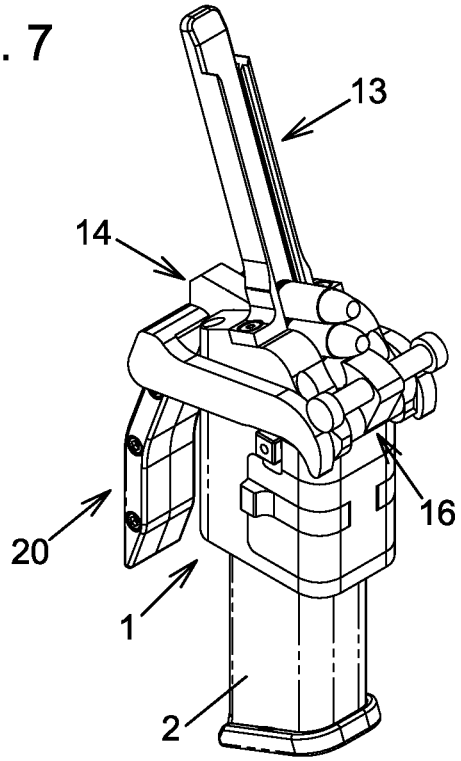
FIG. 7 shows a representation analogous to FIGS. 5 and 6, during resetting of the actuating part up to an intermediate position.
Figure 8:
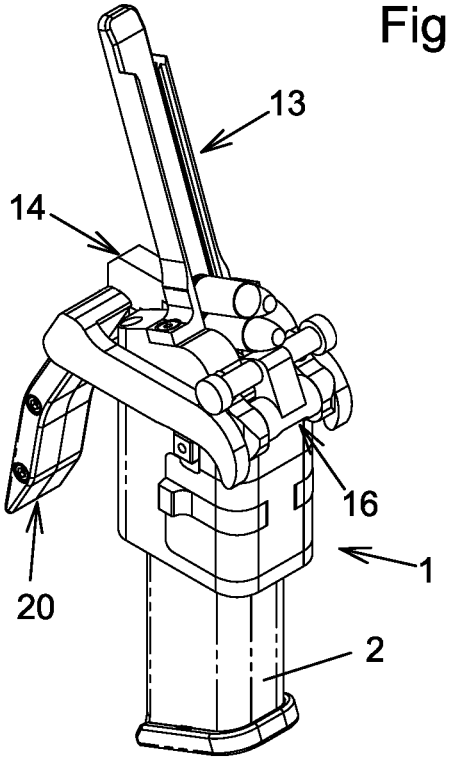
FIG. 8 shows a representation analogous to FIGS. 5 to 7, in the state of the actuating part reset into the starting position.
Figure 9:
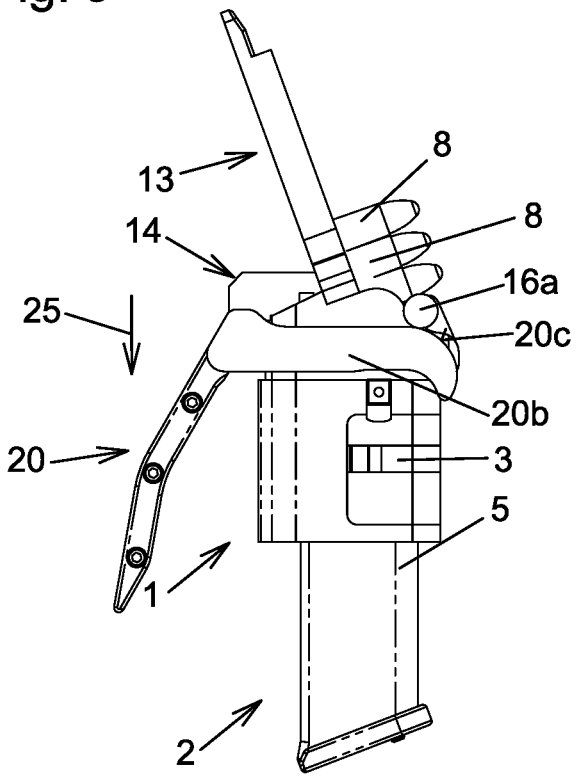
FIGS. 9 to 12 show representations of the loading aid device placed onto the stick magazine with cartridges inserted into the feed part in a side view, in the positions corresponding to FIGS. 5 to 8.
Figure 16:
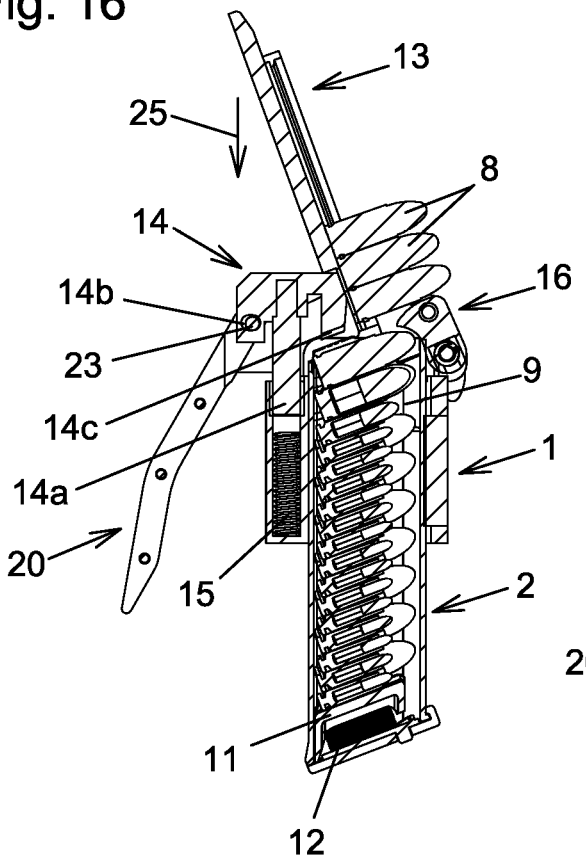
FIG. 16 shows a section along line AA from FIG. 15, in the starting position of the actuating part.

In order to explain the loading process, reference is made in particular to FIGS. 5 to 8, 9 to 12 and 16 to 19 which show different phases of the loading process. FIGS. 5, 9 and 16 show the state at the start of the loading process. The stick magazine 2 is held in the receiving opening 1*a* of the holder part 1 and cartridges 8 are threaded into the undercut groove of the rail 13*a* of the feed part 13. The cartridges slip downward through the action of gravitational force along the rail 13*a* until the lowermost cartridge lies on a bearing surface 16*b* of the pusher 16 located in the push-in position.

Figure 6:
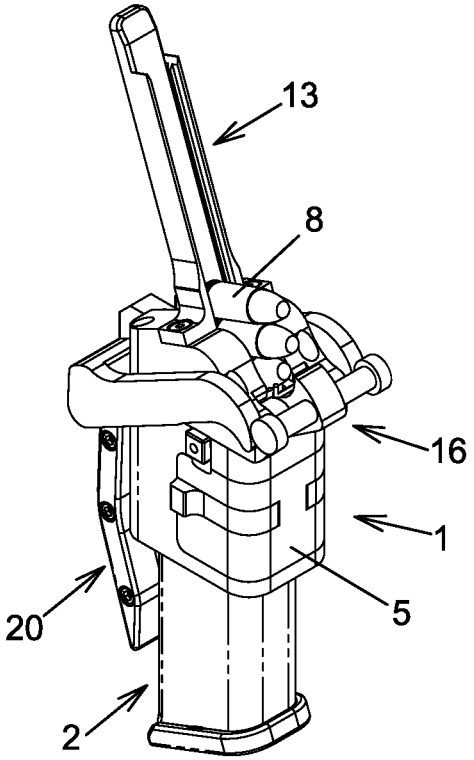
FIG. 6 shows a representation analogous to FIG. 5, in the position of the loading aid device corresponding to FIG. 2.
Figure 10:
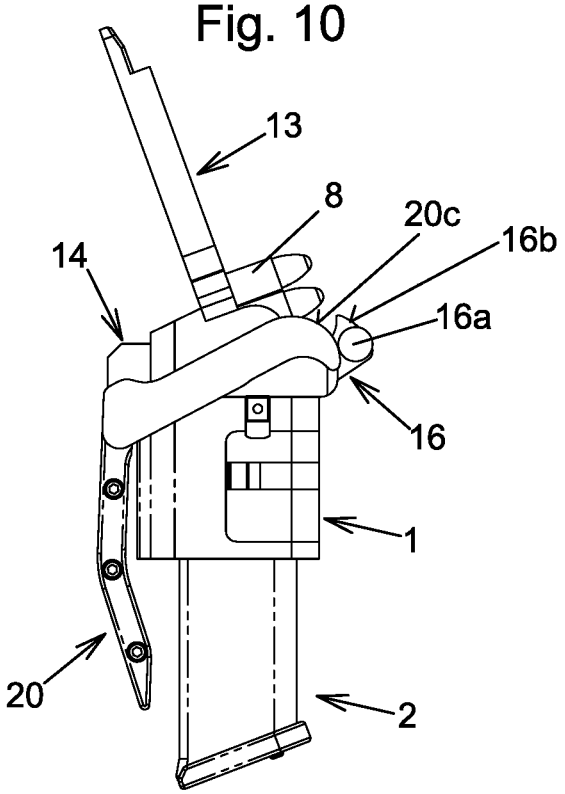
Figure 17:
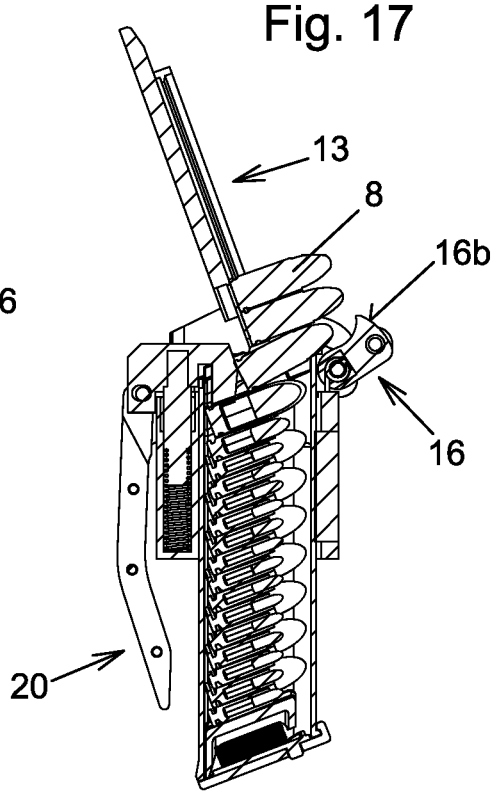
FIGS. 17 to 19 show sections analogous to FIG. 16 in the positions corresponding to FIGS. 6 to 9.

If the actuating part 20 is actuated in that it is pivoted from the starting position into the actuating position, which is represented in FIGS. 6, 10 and 17, the thrust piece 14 is displaced from the passive position into the active position. A tappet portion 14*c* of the thrust piece 14 travels in this case through the intermediate space between the magazine lips 10 into a rear region of the receiving space 9. If cartridges 8 are already arranged in the receiving space 9, the tappet portion 14*c* presses on the uppermost of these cartridges 8 and pushes these together with cartridges possibly lying thereunder and the magazine feed 11 downward counter to the force of the magazine spring 12. If no cartridges 8 are located in the receiving space 9, the tappet portion 14*c* presses directly against the magazine feed 11 and presses it downward. A front free space is freed up as a result of this in a front region of the receiving space 9. This front free space extends to below a front portion of the magazine lips 10.

A pivoting of the pusher 16 about the pusher pivot axis 18 from the push-in position into the feed position is furthermore performed during the adjustment of the actuating part 20 from the starting position into the actuating position by the coupling to the pusher 16. This pivoting of the pusher 16 is performed in the exemplary embodiment by the bearing of the guide pins 16*a* of the pusher 16 against the guide surfaces 20*c* of the actuating part 20.

By pivoting the pusher 16 from the push-in position into the feed position, the bearing surface 16*b* of the pusher, on which the lowermost of the cartridges 8 arranged in the feed part 13, is moved toward the front end of the cartridge and consequently pivoted away from the cartridge. As soon as the bearing surface 16*b* of the pusher 16 has moved beyond the front end of the cartridge 8, it slips downward, wherein it slides out of the lower end of the guide of the feed part 13 and falls through the opening lying in front of the magazine lips 10 on the upper side of the stick magazine 2 into the front free space freed up through the action of the thrust piece 14 in the front region of the receiving space 8 of the stick magazine 2 and in this slips backward until it bears against a side surface of the tappet portion 14*c* of the thrust piece 14. The cartridge 8 then lies in the region of its rear end on the uppermost cartridge 9 already located in the receiving space 9 or, if such a cartridge is not present, on the magazine feeder 11. This rear end of the cartridge 8 lies below the magazine lips 10. In a front portion, the cartridge 8 can lie on the upper edge of the stick magazine 2. A resting on a part of the loading aid device would also be possible. This situation is represented in FIGS. 6, 10 and 17, wherein the location of this cartridge about to be loaded is most clearly apparent from FIG. 17. The next uppermost cartridge located in the feed part 13 is supported on the upper side of this cartridge about to be loaded.

Figure 11:
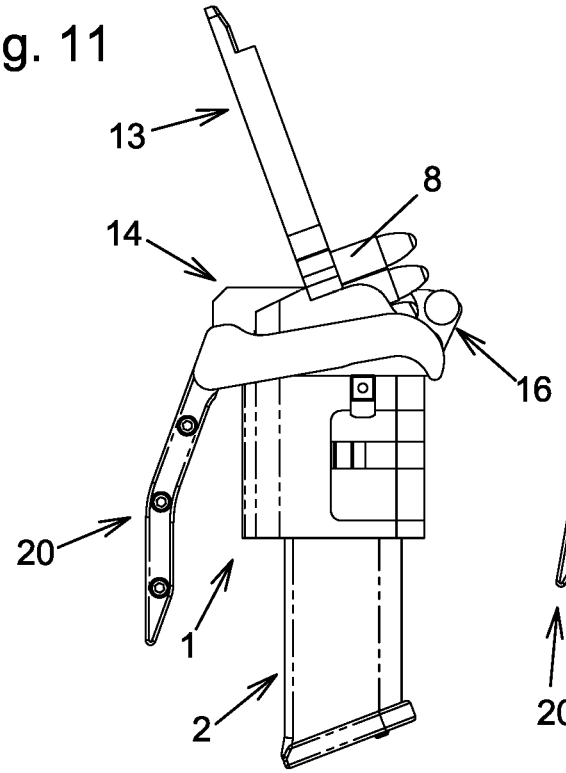
Figure 18:
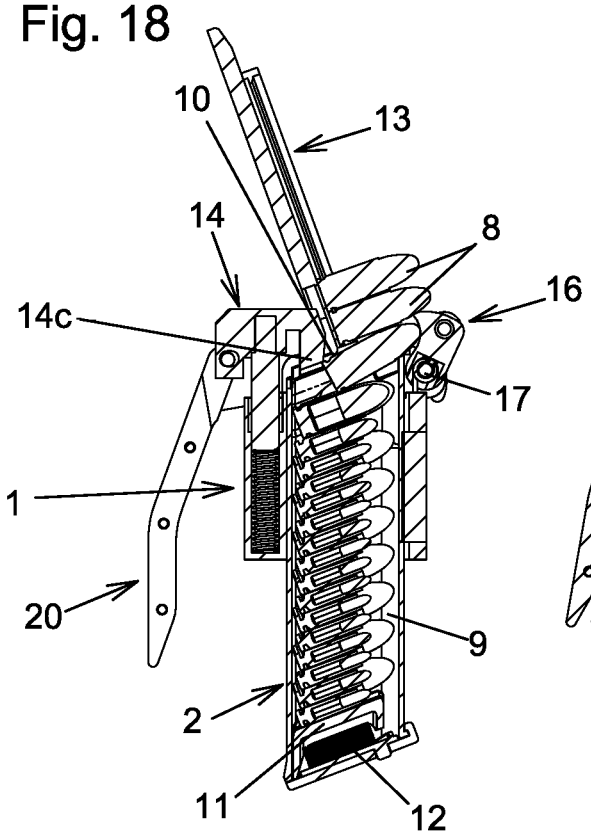

The actuating part is furthermore reset from the actuating position back into the starting position. This can be performed by letting go of the actuating part 20 and the action of the return spring 15. FIGS. 7, 11 and 18 show an intermediate position of the actuating part 20 during resetting.

When resetting the actuating part from the actuating position into the starting position, the tappet portion 14*c* of the thrust piece 14 is increasingly raised up. Since the cartridge 8 about to be loaded lies with its rear side below the magazine lips 10, a driving up of the magazine feeder 11 with the possibly already fully loaded cartridges 8 is blocked. The cartridge about to be loaded is clamped with its rear end between the magazine lips 10 and the uppermost of the cartridges 8 already located in the receiving space 9 or, if no such cartridge is present, the magazine feeder 11. The pusher 16 pivots increasingly from the feed position in the direction of the push-in position until it bears against the tip of the cartridge. At the moment when the pusher 16 comes to bear against the tip of the cartridge 8, the cartridge 8 still bears with its rear side against the tappet portion 14*c*. As a result of this, it is blocked against a further displacement into the rear region of the receiving space 9. In the case of the further resetting of the actuating part 20, the pusher 16 thus remains fixed in this position, wherein the guide pins 16*a* raise up from the guide surfaces 20*c*. This situation is represented in FIGS. 7, 11 and 18. The raising up of the guide pins 16*a* from the guide surfaces 20*c* is apparent in particular from FIG. 11. It is apparent from FIG. 18 that the rear side of the cartridge 8 still bears against the tappet portion 14*c*.

As soon as the actuating part is reset beyond this intermediate position in the direction of the starting position, the tappet portion 14*c* is pulled over the upper end of the rear side of the cartridge 8. A rear free space in the rear region of the receiving space 9 of the stick magazine 2 is thus freed up by the thrust piece 14. This rear free space lies below the magazine lips (10). The cartridge is now pushed into this rear free space through the action of the pusher 16 which presses on the tip of the cartridge 8. In the exemplary embodiment at least to the extent that the guide pins 16*a* once again bear against the guide surface 20*c* of the actuating part 20. In the event of a further resetting of the actuating part 20 in the direction of the starting position, an increasingly further pushing in of the cartridge 8 to be loaded into the rear region of the receiving space 9 is performed.

Figure 12:
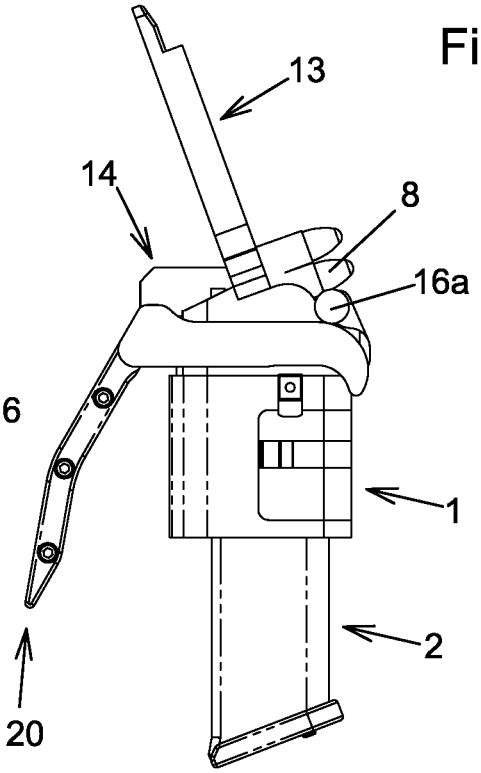
Figure 13:
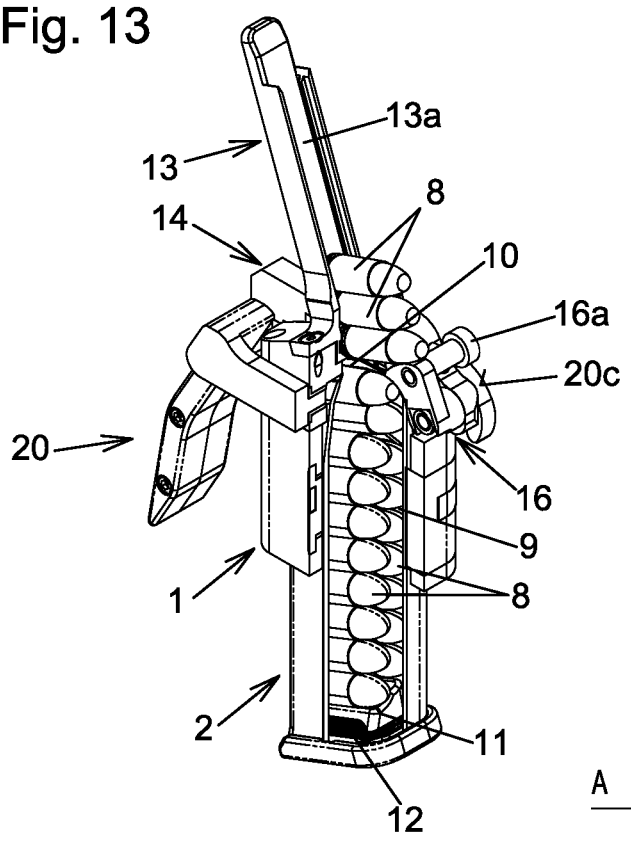
FIG. 13 shows a quarter section.
Figure 14:
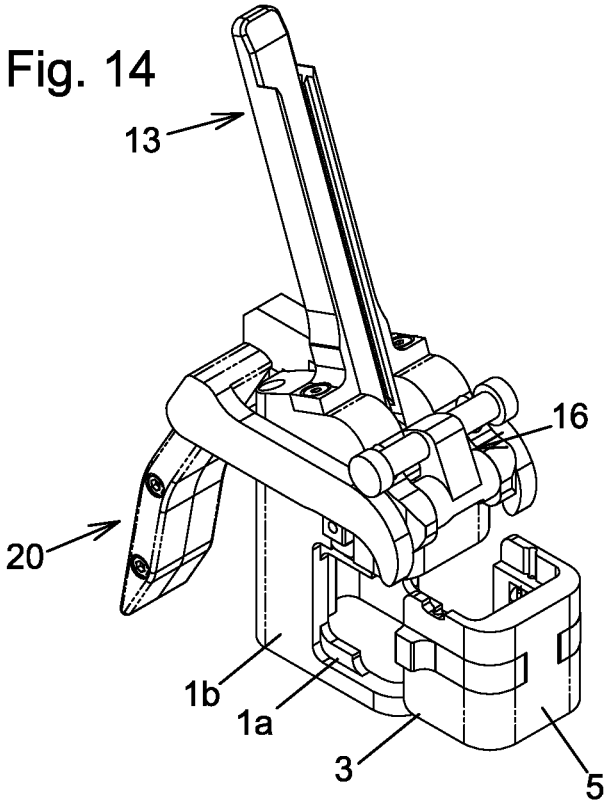
FIG. 14 shows the loading aid device with a removed adapter element.
Figure 15:
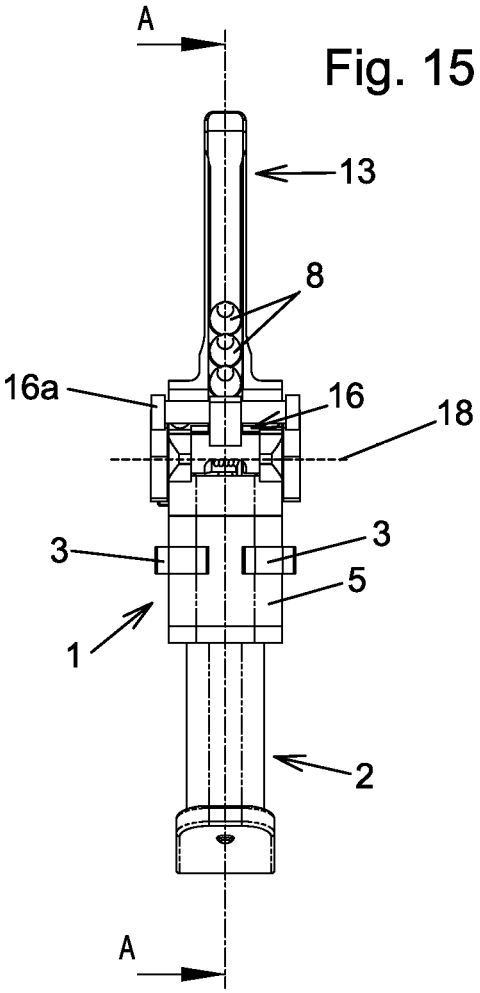
FIG. 15 shows a front view of the loading aid device placed onto a stick magazine with cartridges threaded into the feed part.
Figure 19:
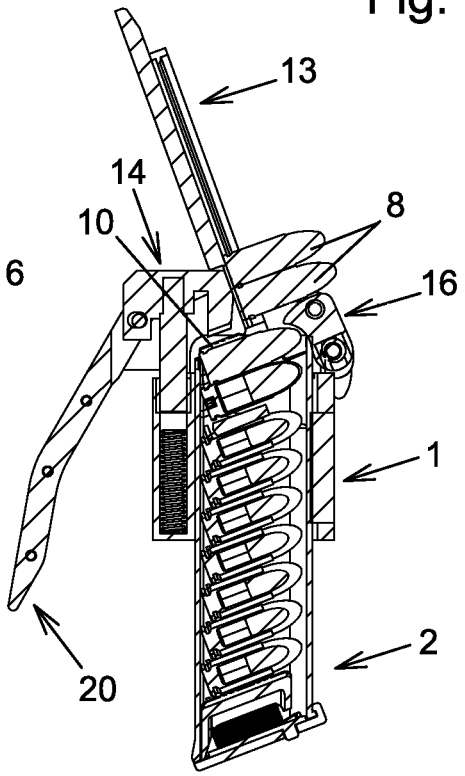
Figure 20:
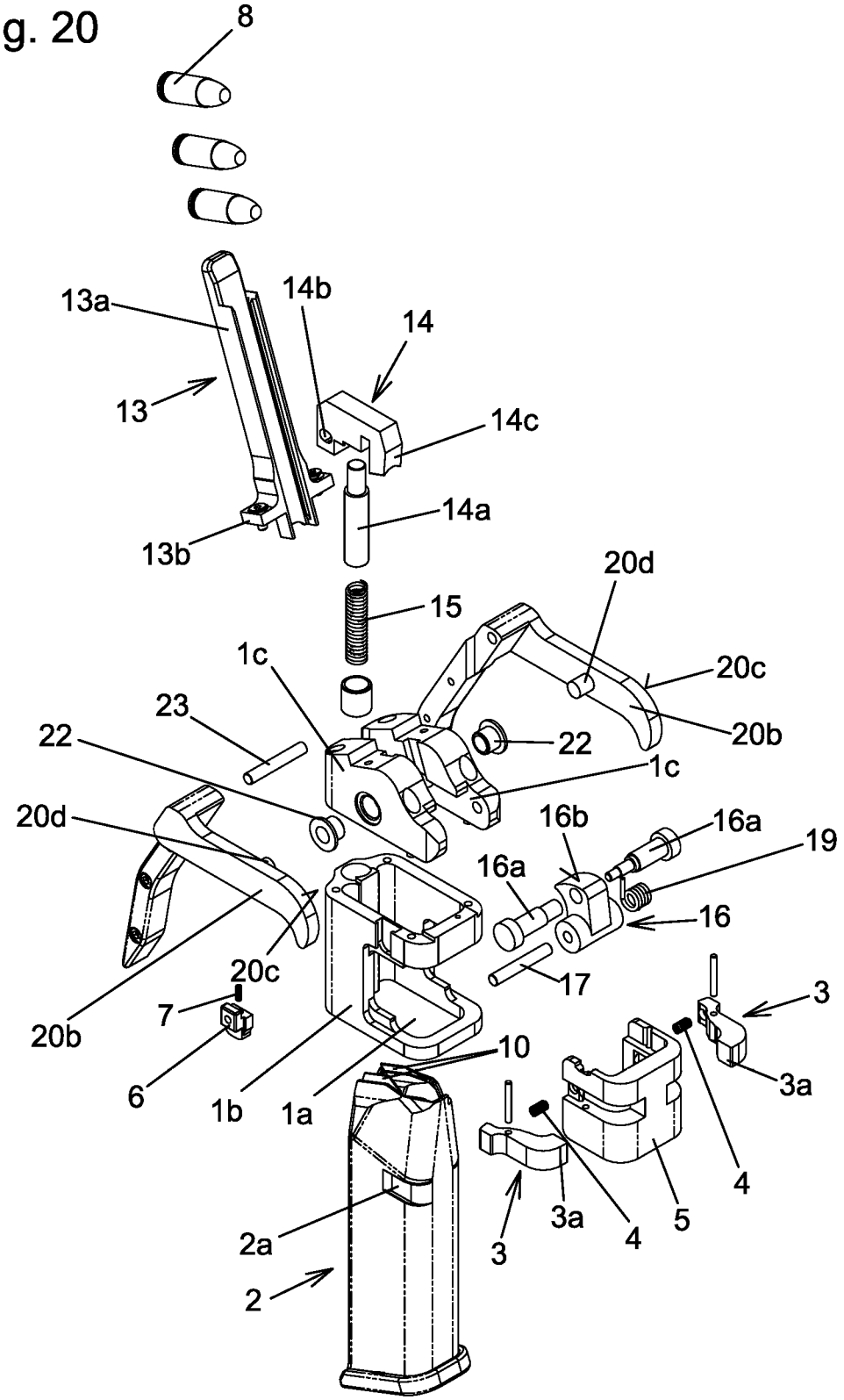
FIG. 20 shows an exploded representation of the loading aid device together with a magazine and a cartridge.

If the actuating part 20 has been reset into the starting position and the pusher 16 has reached the push-in position, the cartridge to be loaded is received entirely in the magazine and has thus reached its loading position, cf. FIGS. 8, 12 and 19.

Figure 21:
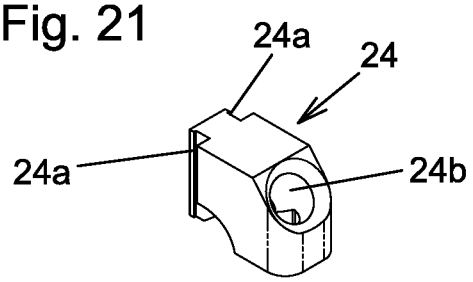
FIGS. 21 and 22 show oblique views of a single-cartridge feed piece from various perspectives.
Figure 22:
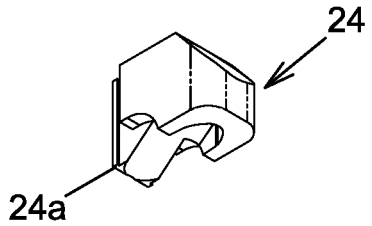
Figure 23:
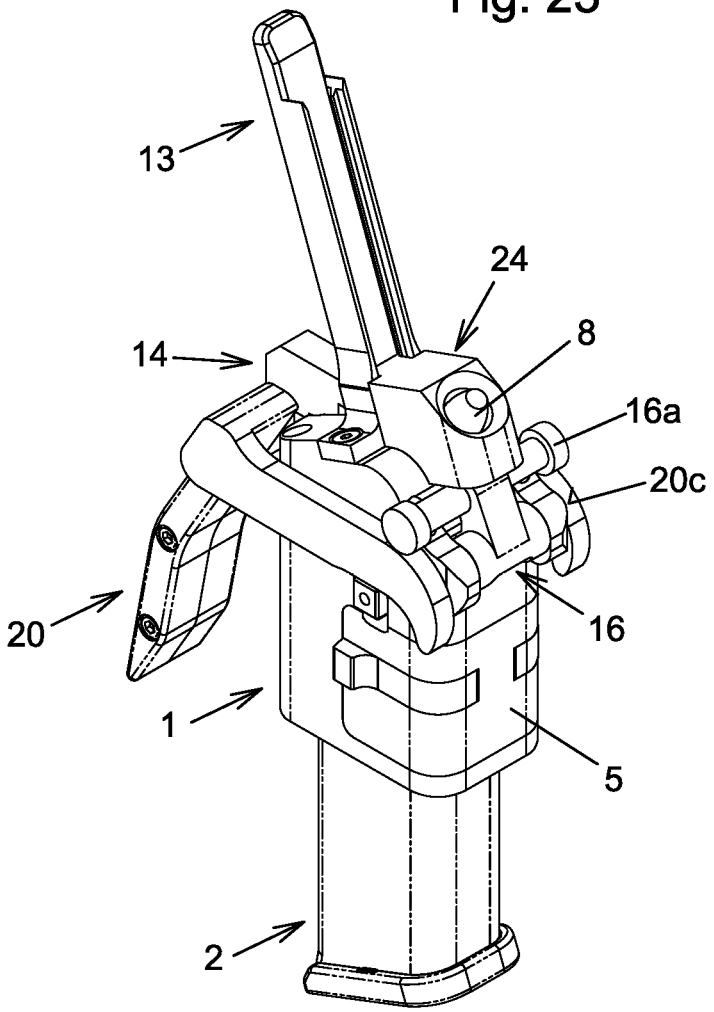
FIG. 23 shows the loading aid device placed onto a stick magazine with inserted single-cartridge supply piece and a cartridge incorporated therein.
Figure 24:
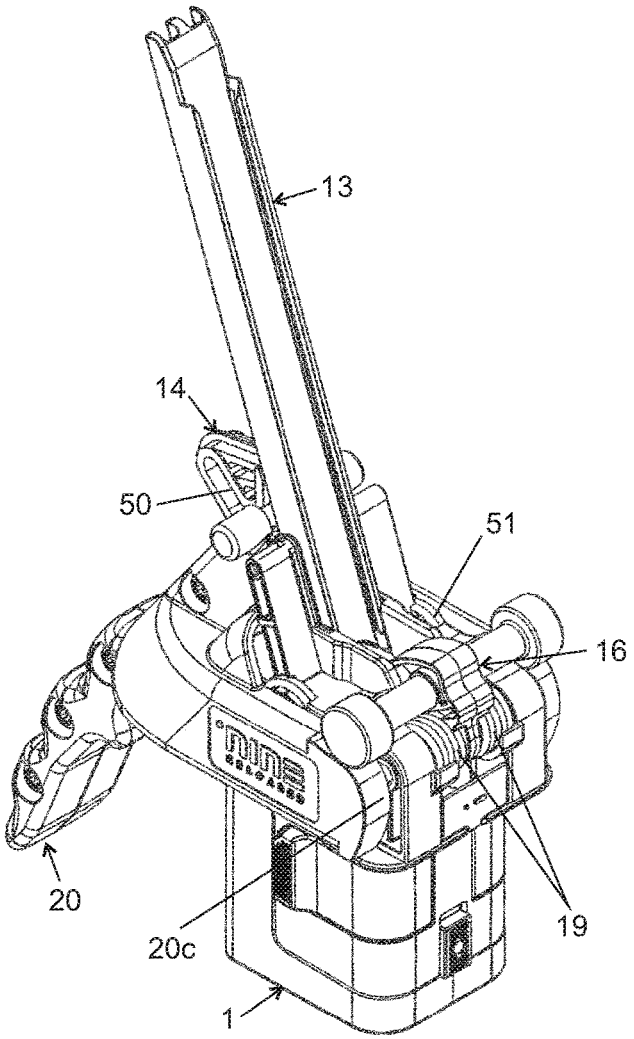
FIG. 24 shows an oblique view of a modified exemplary embodiment of a loading aid device according to the invention in the starting position of the actuating part.
Figure 25:
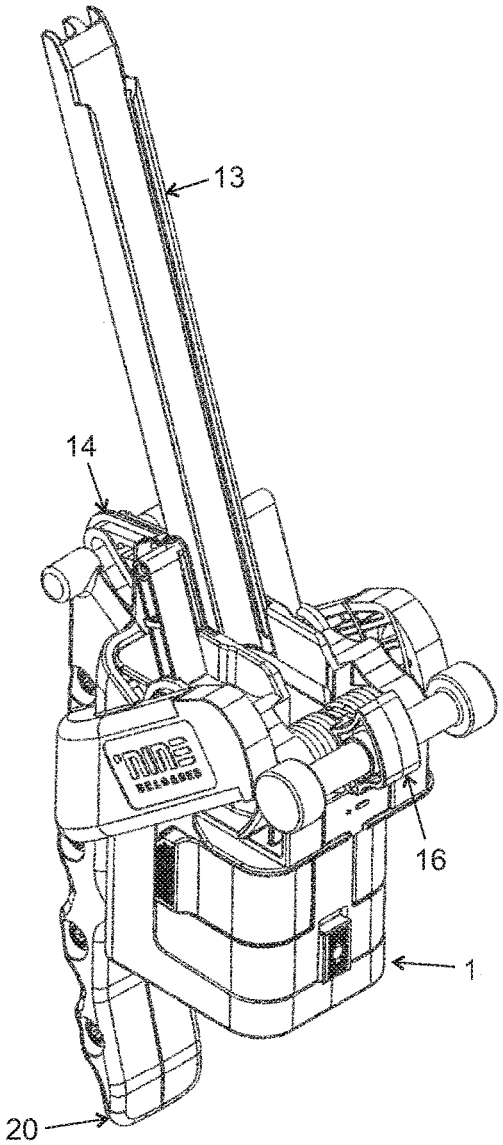
FIG. 25 shows an oblique view corresponding to FIG. 24 in the actuating position of the actuating part.
Figure 26:
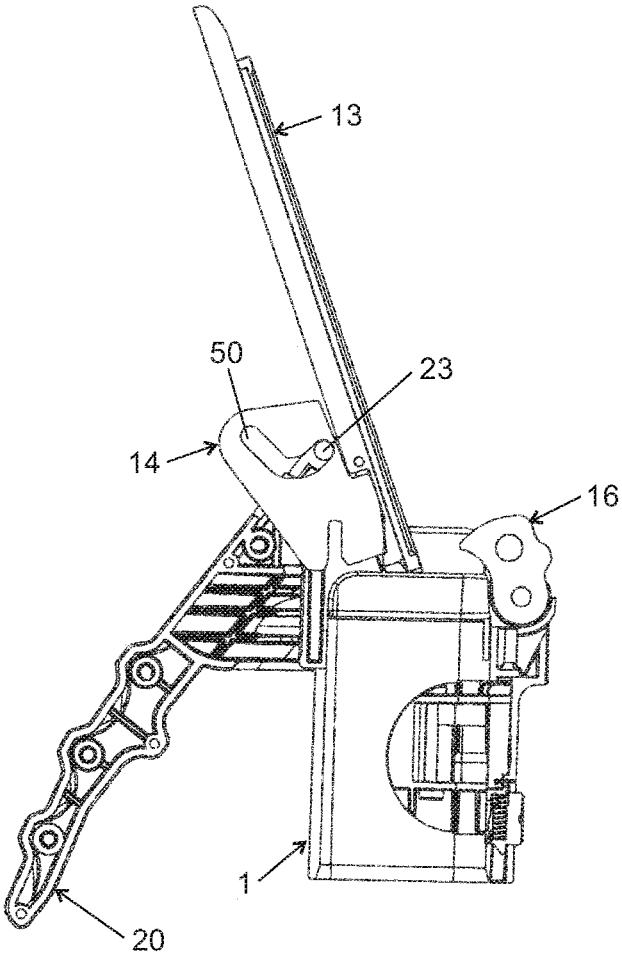
FIGS. 26 and 27 show longitudinal central sections of the loading aid device according to the modified embodiment in the starting position and in the actuating position of the actuating part.
Figure 27:
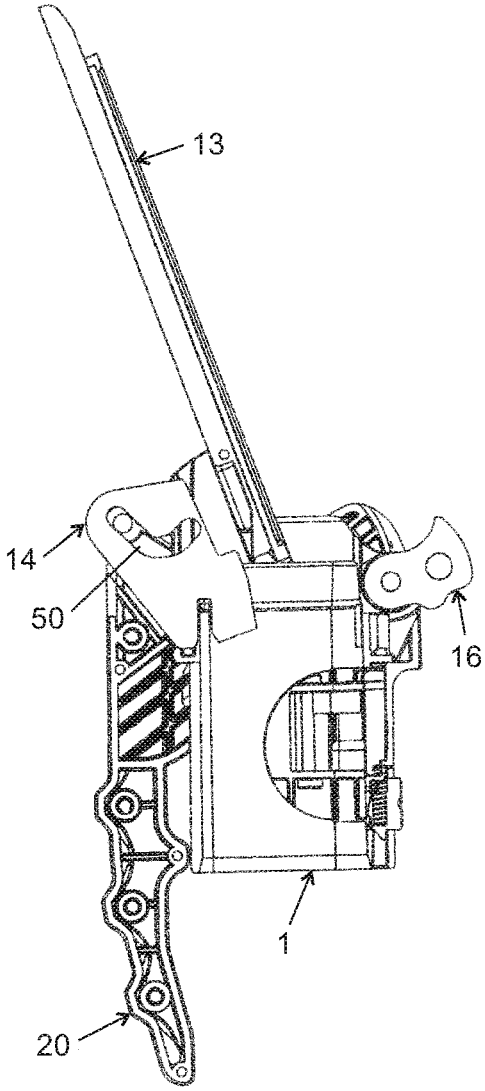
Figure 28:
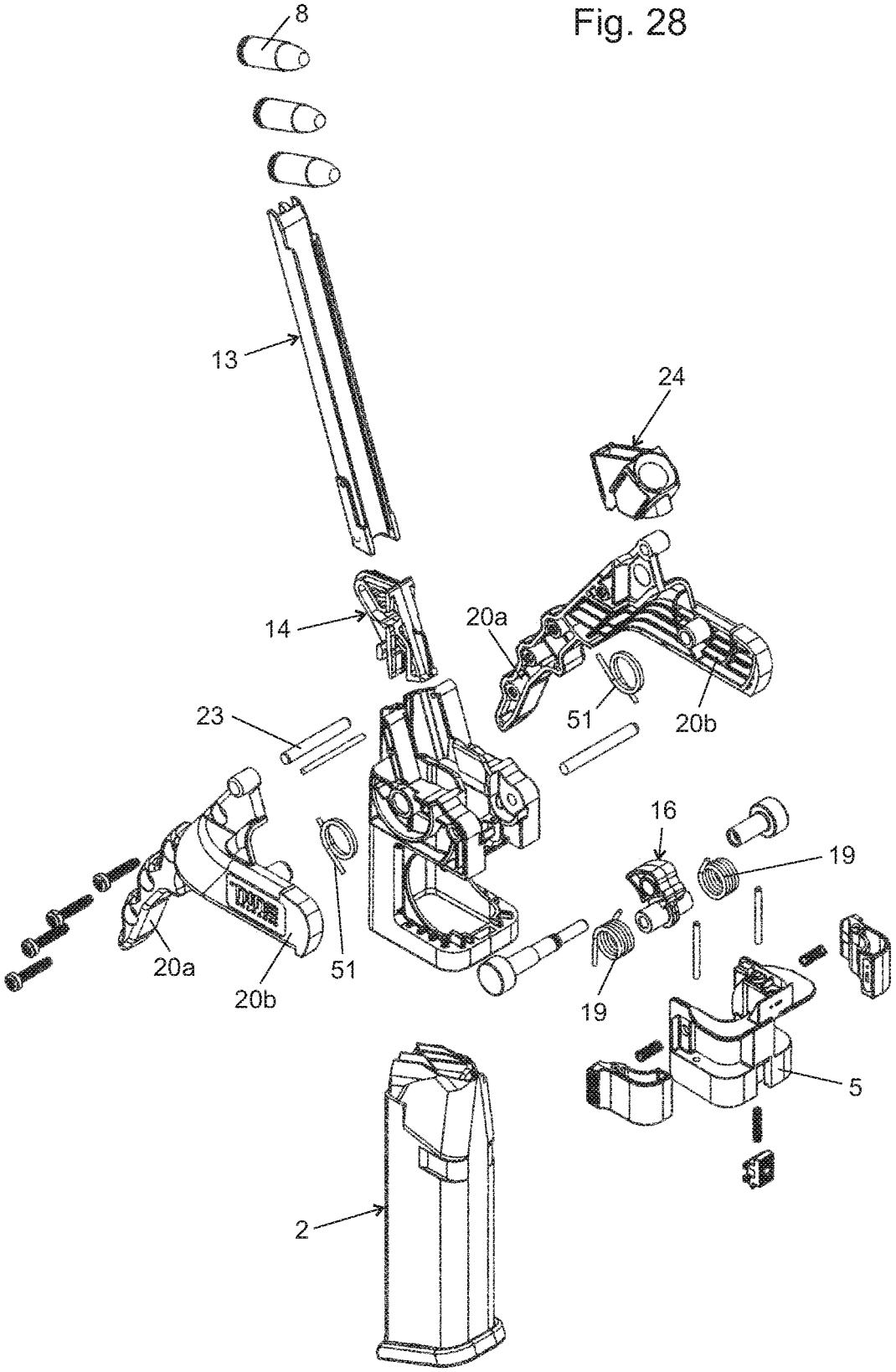
FIG. 28 shows an exploded representation together with a magazine and with cartridges.

In the exemplary embodiment shown, a single-cartridge supply piece is represented as an optional accessory in FIGS. 21 and 22. This can be inserted with laterally protruding guide bars 24*a* into the undercut groove of the feed part 13, cf. FIG. 23. It slips downward therein until it bears against the holder part 1. The single-cartridge feed piece 24 has an opening 24*b* into which a cartridge can be pushed, cf. FIG. 23. The cartridge 8 guided displaceably by the single-cartridge feed piece 24 parallel to its longitudinal direction rests in this case with its rear side on the bearing surface 16*b* of the pusher 16 if it is located in its push-in position. During adjustment of the pusher 16 into the feed position, the bearing surface 16*b* comes out of engagement with the cartridge 8 and the cartridge can slip into the freed up front free space in the receiving space 9 of the stick magazine 2, analogous to feeding via the feed part 13.

In one modified embodiment of the invention, instead of a feed part 13 with a rail 13*a*, a feed part could also be provided in an analogous manner to the single-cartridge feed piece 24, by which a single cartridge is displaceably guided and which could then be mounted fixedly on the holder part 1. The cartridges to be loaded would then have to be fed by the user in each case individually into the single-cartridge feed piece.

Various further modifications of the exemplary embodiment shown are conceivable and possible without departing from the scope of the invention as it is defined in the claims.

For example, the thrust piece 14 could thus be mounted in a different manner displaceably on the holder part 1. A pivotably mounted arrangement of a thrust piece would also be conceivable and possible.

Instead of a return spring which acts on the thrust piece 14 or in addition thereto, a return spring acting on the actuating part 20 could also be provided.

The cartridges 8 can be arranged in the receiving space 9 of the stick magazine 2 in one row or two rows (offset in terms of height).

Instead of a pivotably mounted pusher, a linearly displaceably mounted pusher could in principle also be provided.

Instead of a pivotably mounted actuating part, a linearly displaceably mounted actuating part could in principle also be provided.

In principle, it would also be conceivable and possible to provide separate actuating parts to actuate the thrust piece and to actuate the pusher.

A motorized adjustment of the thrust piece 14 and/or pusher 16 would also be conceivable and possible.

The tension spring 19 and the guide surfaces 20*c* of the actuating part 20 could also be designed so that the tension of the tension spring 19 is increased during pivoting of the pusher 16 from the push-in position in the direction of the feed position by the actuating part 20 directly from the push-in position. The return spring 15 could thus also be dispensed with and the tension spring 19 could also pivot the actuating part 20, if it is located in the active position and let loose, up to the passive position. This pivoting back would furthermore be assisted via a first part of the movement also by the force of the magazine spring 12 acting on the tappet portion 14*c*.

A modified exemplary embodiment of a loading aid device according to the invention is represented in FIGS. 24 to 28. Apart from the differences described below, the formation corresponds substantially to that of the exemplary embodiment described above and the same reference numbers are used for analogous parts.

A first difference lies in the actuation of the thrust piece 14 by the actuating part 20. In this exemplary embodiment, the thrust piece 14 possesses a slotted link 50 into which the coupling pin 23 of the actuating part 20 engages. The advantage of such a slotted link guide lies in further improving the ability to adjust the motion sequence between the thrust piece 14 and the pusher 16. The thrust piece 14 can thus still remain substantially in the passive position, for example, over a first part of the motion of the actuating part 20 starting from the exchange position, while the pusher is already pivoted from the push-in position in the direction of the feed position.

In this modified exemplary embodiment, the spring 15 represented in the first exemplary embodiment can furthermore be dispensed with such that the resetting of the thrust piece 14 in the direction of its passive position is performed by the tension springs 19. For example, two tension springs 19 can be provided here, as represented. Return springs 51 are furthermore present for the actuating part 20, which could in principle also be dispensed with, such that the resetting of the actuating part 20 into the starting position could be performed only by the at least one tension spring 19.

For further improvement of the sequence, the form of the guide surface 20*c* is furthermore slightly modified in comparison with the first exemplary embodiment.

For the sequence of the loading process, reference is made to the description of the first exemplary embodiment.

LEGEND TO THE REFERENCE NUMBERS

1 Holder part
1*a* Receiving opening
1*b* Base part
1*c* Side plate
2 Stick magazine
2*a* Latching recess
3 Latching element
3*a* Latching lug
4 Spring
5 Adapter element
6 Closure element
7 Spring
8 Cartridge
9 Receiving space
10 Magazine lip
11 Magazine feeder
12 Magazine spring
13 Feed part
13*a* Rail
13*b* Flange
14 Thrust piece
14*a* Bearing pin
14*b* Recess
14*c* Tappet portion
15 Return spring
16 Pusher
16*a* Guide pin
16*b* Bearing surface
17 Bearing pin
18 Pusher pivot axis
19 Tension spring
20 Actuating part

20*a* Grip portion
20*b* Guide extension
20*c* Guide surface
20*d* Axle journal
21 Actuating part pivot axis
22 Bearing bush
23 Coupling pin
24 Single-cartridge feed piece
24*a* Guide bar
24*b* Opening
25 Displacement direction
50 Slotted link
51 Return spring

The invention claimed is:

1. A loading aid device for a stick magazine that includes a receiving space for cartridges and a magazine feeder which is acted upon by a magazine spring for pushing an uppermost one of the cartridges located in the stick magazine against magazine lips of the stick magazine, the load aiding device comprising:

a holder part configured for insertion of and fastening the stick magazine (8);

a feed part held on the holder part for displaceable guidance of at least one cartridge to be loaded;

a thrust piece which, in order to push down the magazine feeder together with cartridges possibly already located in the receiving space of the stick magazine and to free up a front free space in a front region of the receiving space, is adjustable between a passive position, in which the thrust piece is adapted to be located entirely outside the receiving space of the stick magazine, and an active position, in which a tappet portion of the thrust piece is configured to protrude between the magazine lips into the receiving space of the stick magazine; and a pusher which is adjustable between a push-in position and a feed position, such that the cartridge to be loaded in the active position of the thrust piece and feed position of the pusher is feedable from the feed part into the front free space of the receiving space and is pushable by the pusher during adjustment of the pusher from the feed position into the push-in position into a rear free space that is freed up during pulling back of the thrust piece from the active position in a direction of the passive position in a rear region of the receiving space up until complete receiving in the stick magazine.

2. The loading aid device as claimed in claim 1, wherein the pusher is acted upon from the feed position by a tension spring in a direction of the push-in position, such that the cartridge to be loaded is pushable into the rear free space by the pusher through action of the tension spring.

3. The loading aid device as claimed in claim 1, wherein the pusher is mounted pivotably on the holder part about a pusher pivot axis.

4. The loading aid device as claimed in claim 1, wherein the feed of the cartridge to be loaded into the front free space of the receiving space in the active position of the thrust piece (14) and feed position of the pusher is adapted to be performed through action of a gravitational force.

5. The loading aid device as claimed in claim 1, further comprising an actuating part provided for adjustment of the thrust piece and of the pusher, the an actuating part is adjustable by a user between a starting position and an actuating position and which is mechanically coupled to the thrust piece and the pusher, wherein, in the starting position of the actuating part, the thrust piece is located in the passive position and the pusher is located in the push-in position and, in an actuating position of the actuating part, the thrust piece is located in the active position and the pusher is located in the feed position.

6. The loading aid device as claimed in claim 5, wherein the actuating part is mounted pivotably on the holder part about an actuating part pivot axis.

7. The loading aid device as claimed in claim 2, wherein the thrust piece is acted upon into the passive position by at least one of a return spring or the tension spring.

8. The loading aid device as claimed in claim 1, wherein the pusher includes a bearing surface on which the cartridge to be loaded is adapted to lie at a start of the loading process and, after pivoting of the pusher, is adapted to be fed from the push-in position into the feed position past the bearing surface of the pusher into the freed up front free space in the front region of the receiving space and up until bearing against the thrust piece protruding into the receiving space below the magazine lips.

9. The loading aid device as claimed in claim 1, wherein upon a continuous adjustment of the actuating part from the actuating position into the starting position, a continuous resetting of the thrust piece from the active position into the passive position is performed, and the pusher is adapted to remain in a same position by way of a release in a connection between the actuating part and the pusher at least over a portion of the adjustment of the actuating part from the actuating position into the starting position.

10. The loading aid device as claimed in claim 9, wherein the actuating part has at least one guide extension with a guide surface against which a guide pin of the pusher bears.

11. The loading aid device as claimed in claim 1, wherein the thrust piece is linearly displaceably mounted on the holder part.

12. The loading aid device as claimed in claim 1, wherein the feed part has a rail with an undercut groove into which cartridges are adapted to be loaded can be threaded, and the cartridges are adapted to be guided by the rail displaceably at a right angle to a longitudinal direction of the rail.

13. The loading aid device as claimed in claim 12, wherein a single-cartridge feed piece is insertable into the undercut groove of the rail of the feed part, said single-cartridge feed piece has an opening adapted for insertion of the cartridge to be loaded in each case individually.

14. The loading aid device as claimed in claim 1, wherein the holder part has an exchangeable adapter element for adjustment of the holder part to different types of stick magazines.

15. The loading aid device as claimed in claim 5, wherein the actuating part is coupled to the thrust piece via a slotted link guide.

16. The loading aid device as claimed in claim 15, wherein the thrust piece has a slotted link into which a coupling pin of the actuating part engages.

17. A method for loading a stick magazine which has a receiving space for cartridges and a magazine feeder which is acted upon by a magazine spring for pushing an uppermost of the cartridges located in the receiving space against magazine lips of the stick magazine, the method comprising:

providing a loading aid device which has a holder part for inserting and fastening the stick magazine and a feed part held on the holder part for displaceable guidance of at least one cartridge to be loaded;

in order to load the cartridge inserted into the feed part:

adjusting a thrust piece from a passive position, in which the thrust piece is located entirely outside the receiving space of the stick magazine, into an active position, with a tappet portion of the thrust piece traveling between the magazine lips into the receiving space of the stick magazine and pushing down the magazine feeder or the magazine feeder and any cartridges already located in the receiving space of the stick magazine, pivoting a pusher from a push-in position into a feed position, wherein the cartridge to be loaded slides into the freed up front free space in the front region of the receiving space and up until bearing against the thrust piece projecting into the receiving space below the magazine lips, retracting the thrust piece in a direction of the passive position, and, after freeing up of a rear free space in a rear region of the receiving space of the stick magazine, pushing the cartridge to be loaded into the rear free space by the pusher through an adjustment thereof from the feed position into the push-in position until the cartridge to be loaded is fully received in the receiving space.

* * * * *